US008038730B2

(12) United States Patent
Itou et al.

(10) Patent No.: US 8,038,730 B2
(45) Date of Patent: Oct. 18, 2011

(54) FIBER PRODUCT TREATING AGENT

(75) Inventors: Masatsugu Itou, Wakayama (JP); Kouji Sasada, Wakayama (JP); Hayato Kinoshita, Wakayama (JP); Akira Ishikawa, Wakayama (JP)

(73) Assignee: Kao Corporation, Tokyo (JP)

( * ) Notice: Subject to any disclaimer, the term of this patent is extended or adjusted under 35 U.S.C. 154(b) by 150 days.

(21) Appl. No.: 12/445,662

(22) PCT Filed: Nov. 12, 2007

(86) PCT No.: PCT/JP2007/072332

§ 371 (c)(1),
(2), (4) Date: May 5, 2009

(87) PCT Pub. No.: WO2008/059978

PCT Pub. Date: May 22, 2008

(65) Prior Publication Data

US 2010/0132126 A1 Jun. 3, 2010

(30) Foreign Application Priority Data

Nov. 13, 2006 (JP) ..... 2006-306753

(51) Int. Cl.
*D06M 15/507* (2006.01)
*C11D 3/37* (2006.01)

(52) U.S. Cl. ..... 8/137; 8/115.6; 252/8.62

(58) Field of Classification Search ..... 8/115.6, 8/137; 252/8.62
See application file for complete search history.

(56) References Cited

U.S. PATENT DOCUMENTS

| | | | |
|---|---|---|---|
| 4,617,340 | A | 10/1986 | Tanaka et al. |
| 4,956,447 | A | 9/1990 | Gosselink et al. |
| 5,207,933 | A | 5/1993 | Trinh et al. |

FOREIGN PATENT DOCUMENTS

| | | | | |
|---|---|---|---|---|
| EP | 0 185 427 | A2 | | 12/1985 |
| JP | 60-259680 | A | | 12/1985 |
| JP | 5-508889 | A | | 12/1993 |
| JP | 9-291483 | A | | 11/1997 |
| JP | 2000-110076 | A | | 4/2000 |
| JP | 2001-279581 | A | | 10/2001 |
| JP | 2007-46171 | A | | 2/2007 |
| JP | 2007-284818 | A | | 11/2007 |
| WO | WO-92/01773 | A1 | | 2/1992 |
| WO | WO-95/24460 | A1 | | 9/1995 |
| WO | WO 99/27050 | | * | 6/1999 |

* cited by examiner

*Primary Examiner* — Amina Khan
(74) *Attorney, Agent, or Firm* — Birch, Stewart, Kolasch & Birch, LLP

(57) ABSTRACT

The present invention relates to a fiber product treating agent containing, in a predetermined mass ratio, (a1) a silicone compound and (b) a polymer compound having a weight-average molecular weight of 1,000 to 100,000, containing an alkylene terephthalate unit and/or an alkylene isophthalate unit, and a polyoxyalkylene unit, and further containing (c) at least one compound selected from (c1) a specific tertiary amine compound, or acid salt thereof or a quaternization product thereof, and (c2) a cationic water-soluble polymer compound, and a fiber product treating agent containing, in a predetermined mass ratio, (a2) an amino-modified silicone compound and/or an amide-modified silicone compound and (b) a polymer compound having a weight-average molecular weight of 1,000 to 100,000, containing an alkylene terephthalate unit and/or an alkylene isophthalate unit, and a polyoxyalkylene unit.

6 Claims, No Drawings

FIBER PRODUCT TREATING AGENT

FIELD OF THE INVENTION

The present invention relates to a fiber product treating agent.

BACKGROUND OF THE INVENTION

A silicone compound can confer unique slipping property and feel on fiber products and is thus widely used in fiber product treating agents. As described in JP-A 2007-46171, JP-A 5-508889, JP-A 2001-279581 and JP-A 2000-110076, fiber product treating agents based on a silicone compound have been examined in recent years as treating agents used in a washing process at home.

Meanwhile, polyester-based polymer compounds containing an alkylene terephthalate and alkylene isophthalate as structural units are known as a soil release agent and applied to detergents etc. For the purpose of industrially conferring a soil release effect on fiber products, JP-A 9-291483 discloses techniques of simultaneously using a polyester polymer compound and a polyether-modified silicone.

SUMMARY OF THE INVENTION

The present invention relates to a fiber product treating agent containing (a1) a silicone compound (referred to hereafter as component (a1)), (b) a polymer compound having a weight-average molecular weight of 1,000 to 100,000, containing an alkylene terephthalate unit and/or an alkylene isophthalate unit, and a polyoxyalkylene unit (referred to hereafter as component (b)), and (c) at least one compound selected from (c1) a tertiary amine compound, or acid salt thereof or a quaternalized product thereof, wherein out of 3 or 4 groups bound to the nitrogen atom thereof, 1 to 3 groups each represent a hydrocarbon group having 10 to 24 carbon atoms and the remaining group(s) represents an alkyl or hydroxyalkyl group having 1 to 3 carbon atoms, and (c2) a cationic water-soluble polymer compound (referred to hereafter as component (c)), wherein the mass ratio of (a1) to (b), that is, (a1)/(b) is from 80/20 to 99.9/0.1.

The present invention relates to a fiber product treating agent containing, (a2) an amino-modified silicone compound and/or an amide-modified silicone compound (referred to hereafter as component (a2)) and (b) a polymer compound having a weight-average molecular weight of 1,000 to 100,000, containing an alkylene terephthalate unit and/or an alkylene isophthalate unit, and a polyoxyalkylene unit (referred to hereafter as component (b)), wherein the mass ratio of (a2) to (b), that is, (a2)/(b) is from 80/20 to 99.9/0.1.

Also, the present invention relates to a method of treating fiber products, which includes adding the fiber product treating agent of the invention described above to rinsing water in a rinsing step of washing to treat fiber products.

DETAILED DESCRIPTION OF THE INVENTION

The fiber product treating agents based on a silicone compound give preferable texture to fiber products but deteriorate water-absorbing property and impair the water-absorbing property of particularly cotton-containing fiber products, so there is strong demand for improvement in this regard. JP-A 5-508889, and JP-A 2007-46171 distributed on Feb. 22, 2007, do not still have a satisfactory effect against such problem.

In JP-A 2001-279581, a polyether-modified silicone compound can be used to improve water-absorbing property, but is poor in adsorption onto fibers and cannot give sufficient texture.

JP-A 9-291483, on the other hand, discloses a means of solving the problem in a step of conferring an antifouling effect on fiber products, and describes that a softening effect, hydrophilicity and antifouling property can be conferred on fiber products, but cannot be said to disclose a treating agent capable of giving excellent softness and water-absorbing property even in a mode of use where the treating agent is used at relatively low concentration, for example in a mode of use such as in daily treatments at home.

Accordingly, the present invention relates to a fiber product treating agent which solves the problem of deterioration in water-absorbing property upon treatment with a fiber product treating agent based on a silicone compound, and thereby achieving both excellent softness and water-absorbing property.

According to the present invention, there is provided a fiber product treating agent based on a silicone compound, which confers excellent softness and water-absorbing property. The present invention provides a fiber product treating agent treating agent based on a silicone compound, which can confer excellent softness by solving the problem of deterioration in water-absorbing property upon treatment with the fiber product treating agent.

<Component (a1)>

The silicone compound as the component (a1) in the present invention includes silicone compounds such as dimethyl polysiloxane, quaternary ammonium-modified dimethyl polysiloxane, amino-modified dimethyl polysiloxane, amide-modified dimethyl polysiloxane, epoxy-modified dimethyl polysiloxane, carboxy-modified dimethyl polysiloxane, polyoxyalkylene-modified dimethyl polysiloxane and fluorine-modified dimethyl polysiloxane.

The silicone compound as the component (a1) in the present invention is preferably at least one member selected from dimethyl polysiloxane, amino-modified dimethyl polysiloxane, amide-modified dimethyl polysiloxane, and polyoxyalkylene (for example polyoxyethylene and/or polyoxypropylene, preferably polyoxyethylene)-modified dimethyl polysiloxane, and is more preferably amino-modified dimethyl polysiloxane, or polyoxyalkylene (for example polyoxyethylene and/or polyoxypropylene, preferably polyoxyethylene)-modified dimethyl polysiloxane, from the viewpoint of softening effect.

The dimethyl polysiloxane includes those compounds having a weight-average molecular weight of 1,000 to 1,000,000, preferably 3,000 to 500,000, more preferably 5,000 to 250,000, and a viscosity at 25° C. of 10 to 100,000 $mm^2/s$, preferably 500 to 50,000 $mm^2/s$, particularly preferably 1,000 to 40,000 $mm^2/s$.

The amino-modified dimethyl polysiloxane has an amino equivalent (the amino equivalent is molecular weight per nitrogen atom) of preferably 1,500 to 40,000 g/mol, more preferably 2,500 to 20,000 g/mol, even more preferably 3,000 to 10,000 g/mol. The amino-modified dimethyl polysiloxane includes those compounds having a viscosity at 25° C. of preferably 100 to 20,000 $mm^2/s$, more preferably 200 to 10,000 $mm^2/s$, even more preferably 500 to 5,000 $mm^2/s$.

A preferable polyoxyalkylene-modified dimethyl polysiloxane is a compound which in the form of 1% aqueous solution, has a cloud point of 80° C. or less, more preferably 70° C. or less. The compound having a cloud point in this range is highly hydrophobic and is considered liable to adsorption onto fiber products. The viscosity of the compound at 25° C. is 100 to 6500 $mm^2/s$, preferably 200 to 6000 $mm^2/s$, particularly preferably 500 to 5500 $mm^2/s$.

From the viewpoint of improving water-absorbing property particularly in repeated use in the present invention, amino-modified dimethyl polysiloxane and polyoxyalkylene-modified dimethyl polysiloxane are preferably simultaneously used wherein the amino-modified dimethyl polysiloxane/polyoxyalkylene-modified dimethyl polysiloxane ratio by mass is preferably 100/0 to 10/90, more preferably 95/5 to 20/80, even more preferably 90/10 to 30/70.

Commercially available silicone can also be used, and preferable examples include Polon MF-14, Polon MF-14D, Polon MF-14EC, Polon MF-29, Polon MF-39, Polon MF-44, Polon MF-52, KF-615A, KF-618, KF-864, KF-945A, and KF-6008 manufactured by Shin-Etsu Chemical Co., Ltd., Y-7006, FZ-2203, FZ-2207, FZ-2120, FZ-2161, FZ-2163, FZ-2165, SM8702, SM8704, SM8702C, SM8704C, BY22-812, BY22-816, BY22-819, BY22-823, BY16-850, BY16-906, SF8471, BY22-019, SH-3746, SH-3771, SH3775M, SH-8400, SF-8410, SF8457C and SH-8700 manufactured by Dow Corning Toray Silicone Co., Ltd.

<Component (a2)>

The component (a2) in the present invention is an amino-modified silicone compound and/or an amide-modified silicone compound. The amino-modified silicone compound as the component (a2) in the present invention has an amino equivalent (the amino equivalent is molecular weight per nitrogen atom) of preferably 1,500 to 40,000 g/mol, more preferably 2,500 to 20,000 g/mol, even more preferably 3,000 to 10,000 g/mol. The degree of amide modification can be calculated from amino equivalent. The component (a2) includes those compounds having a dynamic viscosity at 25° C. of preferably 100 to 20,000 $mm^2/s$, more preferably 200 to 10,000 $mm^2/s$, even more preferably 500 to 5,000 $mm^2/s$.

The dynamic viscosity can be determined with an Ostwald-type viscometer, and the amino equivalent can be determined in terms of weight-average molecular weight per nitrogen atom, that is, according to the formula: amino equivalent=molecular weight/the number of N atoms. The molecular weight is a value determined by gel permeation chromatography with polystyrenes as standards, and the number of nitrogen atoms can be determined by an elemental analysis method.

The amide-modified silicone as the component (a2) in the present invention can be obtained by a known method of amidating the amino-modified silicone as the component (a2) in the present invention with an acylating agent such as a fatty acid chloride or fatty acid anhydride having 2 to 22 carbon atoms, preferably 2 to 18 carbon atoms. The amide-modified silicone as the component (a2) in the present invention may be an amide-modified silicone structured to have an amide bond in a main chain, as exemplified in JP-B 2001-512164. The component (a2) may contain, in its molecule, both amino and amide groups or may contain a modifying group (for example, a polyether group or the like) other than amino and amide groups.

Commercially available amino- or amide-modified silicone can also be used. Preferable examples of the amino-modified silicone include X-22-161A, KF-22-1660B-3, KF-8008, KF-8012, KF-393, KF-859, KF-860, KF-869, KF-8005, KF-864, KF-865, KF-868, and KF-8003 manufactured by Shin-Etsu Chemical Co., Ltd. and FZ-3508, BY16-205, FZ-3705, BY16-850, FZ-3501, FZ-3785, BY16-213, BY16-203, BY16-849, BY16-890, BY16-893, and SS-3588 manufactured by Dow Corning Toray Silicone Co., Ltd. Preferable examples of the amide-modified silicone include BY16-898, BY16-891, and Dow Corning 2-8178 Gellant manufactured by Dow Corning Toray Silicone Co., Ltd.

<Component (b)>

The component (b) in the present invention is a copolymer containing an alkylene terephthalate unit and/or an alkylene isophthalate unit, and a polyoxyalkylene unit, and is a polymer compound wherein an alkylene terephthalate unit and/or an alkylene isophthalate unit, and a polyoxyalkylene unit, are polymerized as basic units in a random or block form. For improving solubility and dispersibility in water, the polymer compound into which sulfo groups are partially introduced can also be used.

The alkylene terephthalate unit includes one or two or more members selected from an ethylene terephthalate unit, a propylene terephthalate unit, a butylene terephthalate unit etc., among which an ethylene terephthalate unit is preferable.

The alkylene isophthalate unit includes one or two or more members selected from an ethylene isophthalate unit, a propylene isophthalate unit, a butylene isophthalate unit etc., among which an ethylene isophthalate unit is preferable.

The polyoxyalkylene unit includes one or two or more members selected from a polyoxyethylene unit, a polyoxypropylene unit, a polyoxyethylene polyoxypropylene unit etc.

The molar ratio of (the alkylene terephthalate unit and/or the alkylene isophthalate unit)/the polyoxyalkylene unit is preferably 90/10 to 40/60, more preferably 80/20 to 45/55, even more preferably 70/30 to 50/50. The weight-average molecular weight of the component (b) is preferably 1,000 to 100,000, more preferably 6,000 to 85,000.

The content (%) of the alkylene terephthalate unit and/or the alkylene isophthalate unit, and the polyoxyalkylene unit, in the component (b) is preferably 90 mol % or more, more preferably 95 mol % or more.

In the present invention, the component (b) is particularly preferably a polymer compound having a weight-average molecular weight of 1,000 to 100,000, containing a monomer structural unit (1-1) of formula (I-1) below and a monomer structural unit (1-2) of formula (I-2) below wherein the molar ratio of (1-1)/(1-2) is from 10/90 to 90/10. The monomer structure units (1-1) and (1-2) may be arranged in either a random or block form.

(1-1)

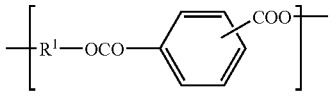

(1-2)

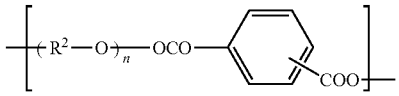

wherein $R^1$ and $R^2$ each represent an alkylene group having 2 or 3 carbon atoms and may be the same or different, and n is a number of 1 to 150, preferably 10 to 100, indicating the number of units added on average.

The method of producing the polymer compound as the component (b) in the present invention is not particularly limited; for example, in the presence of a catalyst in an inert gas, a dicarboxylic acid component and a glycol component are subjected to esterification reaction or ester exchange reaction under heating at 160 to 270° C. to prepare a glycol ester, and in appropriate timing thereafter, a polyalkylene glycol is added to, and mixed with, the glycol ester and then polymerized at ordinary pressures or under reduced pressure. The catalyst that can be used herein includes metal oxides and organometallic compounds such as barium oxide, antimony oxide, zinc acetate, manganese acetate, cobalt acetate, zinc succinate, tetrabutyl titanate, magnesium methoxide and sodium methoxide.

The weight-average molecular weight of the component (b) can be determined by gel permeation chromatography with polyethylene glycols as standards in a mixed solution of acetonitrile and water (phosphate buffer) as a developing solvent.

<Component (c)>

The treating agent of the present invention contains (c) at least one compound (referred to hereafter as component (c)) selected from (c1) a tertiary amine compound, or acid salt thereof, or a quaternization product thereof, wherein 1 to 3 groups of 3 or 4 groups bound to the nitrogen atom thereof each represent a hydrocarbon group having 10 to 24 carbon atoms and the remaining group (s) represents an alkyl or hydroxyalkyl group having 1 to 3 carbon atoms (referred to hereafter as component (c1)), and (c2) a cationic water-soluble polymer compound (referred to hereafter as component (c2)). The component (c) in the present invention improves adsorption of the component (a1), thereby improving the effect of conferring softness.

Specifically, the component (c1) is preferably a dialkyl (C10 to C16) dimethyl ammonium salt or an N,N-dialkyloyl (or alkenoyl) (C12 to C20) oxyethyl-N-hydroxyethyl-N-methyl (or ethyl) ammonium salt.

The component (c2) is a cationic water-soluble polymer compound. With the term "water-soluble" used herein, the polymer compound is defined as a compound which upon dissolution and/or dispersion in water at 20° C. and adjustment to pH 5.0, is dissolved at a concentration of 1 mass % or more. With the term "cationic" given, the polymer compound is defined as a polymer compound containing, in its molecule, a quaternary ammonium group or an acid salt of a tertiary amino group, which is preferably a polymer compound having, in its molecule, 5 to 100 mol %, preferably 10 to 95 mol %, more preferably 15 to 90 mol % monomer units having a quaternary ammonium group or an acid salt of a tertiary amino group. When an anionic group (X) selected from a carboxylic acid group and a sulfonic acid group is present in the polymer compound, (total number of moles of the quaternary ammonium group and the acid salt of a tertiary amino group in the molecule)/(number of moles of the anionic group (X) in the molecule) is preferably 1.1 or more, more preferably 2 or more.

Specifically, the component (c2) is preferably a polymer compound obtained by polymerizing a compound of formula (7), acid salt thereof or a quaternalized product thereof (referred to hereinafter as (c2·m1)):

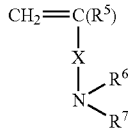

(7)

wherein $R^5$ represents a hydrogen atom or a methyl group, X is selected from —$COOR^8$—, —$CON(R^9)R^{10}$—, —$OCOR^{11}$— and —$CH_2$—, and when X is —$CH_2$—, $R^6$ is $CH_2$=$C(R^5)$—$CH_2$—, and X is other than —$CH_2$—, $R^6$ is an alkyl or hydroxyalkyl group having 1 to 3 carbon atoms; $R^7$ represents an alkyl or hydroxyalkyl group having 1 to 3 carbon atoms; $R^8$, $R^{10}$ and $R^{11}$ each represent an ethylene or propylene group; and $R^9$ represents a hydrogen atom or a methyl group.

Specifically, (c2·m1) is preferably at least one member selected from N-(meth)acryloyloxyethyl-N,N-dialkylamine, or acid salt thereof or a quaternary ammonium salt thereof (number of carbon atoms in the alkyl group: 1 to 3), N-(meth) acryloylaminopropyl-N,N-dialkylamine, or acid salt thereof or a quaternary ammonium salt thereof (number of carbon atoms in the alkyl group: 1 to 3), N-vinyloxycarbonylethyl-N, N-dialkylamine, or acid salt thereof or a quaternary ammonium salt thereof (number of carbon atoms in the alkyl group: 1 to 3), and N,N-diallyl-N-alkylamine, or acid salt thereof or a quaternary ammonium salt thereof (number of carbon atoms in the alkyl group: 1 to 3), among which N-(meth) acryloyloxyethyl-N,N-dialkylamine, N-(meth)acryloylaminopropyl-N,N-dialkylamine, or their acid salts or quaternary ammonium salts (number of carbon atoms in the alkyl group: 1 to 3) are particularly preferable.

When (c2·m1) is in the form of an acid salt, it is possible to use not only an inorganic acid salt selected from a hydrochloride, a sulfate and a phosphate and an inorganic or organic acid salt selected from a fatty acid salt having 1 to 12 carbon atoms and an aryl sulfonate which may be substituted with 1 to 3 alkyl groups each having 1 to 3 carbon atoms, but also an anionic surfactant salt selected from an alkyl benzene sulfonate having 10 to 24 carbon atoms, an alkyl sulfate having 10 to 24 carbon atoms, and a polyoxyethylene alkyl ether sulfate having a C10 to C24 alkyl group and having 1 to 4 moles on the average of oxyethylene added thereto.

When (c2·m1) is in the form of a quaternary ammonium salt, it is possible to use a product obtained by quaternarizing the compound of formula (7) with an alkylating agent selected from methyl chloride, dimethylsulfuric acid, diethylsulufric acid, ethylene oxide, and propylene oxide.

When (c2·m1) is in the form of an amine, (c2·m1) is polymerized and then neutralized with a usual acid or quaternarized with a usual alkylating agent to make it cationic. The neutralizing agent that can be used includes an inorganic acid selected from hydrochloric acid, sulfuric acid and phosphoric acid, a fatty acid having 1 to 12 carbon atoms, a generally known organic or inorganic acid selected from arylsulfonic acids which may be substituted with 1 to 3 alkyl groups each having 1 to 3 carbon atoms, and an acid-form compound of an anionic surfactant selected from an alkylbenzene sulfonic acid having 10 to 24 carbon atoms, an alkyl sulfuric acid monoester having 10 to 24 carbon atoms, and a polyoxyethylene alkyl ether sulfuric acid monoester having a C10 to C24 alkyl group and having 1 to 4 moles on the average of oxyethylene added thereto. The alkylating agent includes methyl chloride, dimethylsulfuric acid, diethylsulufric acid, ethylene oxide, and propylene oxide.

The component (c2) in the present invention may be a copolymer of (c2·m1) and a compound copolymerizable therewith (referred to hereinafter as (c2·m2)). When (c2·m2) is copolymerized with the compound of (c2·m2) which further has a carboxylic acid (salt) group or a sulfonic acid (salt) group (referred to hereinafter as c2·m2a), the two are copolymerized at a (c2·m1)/(c2·m2a) molar ratio of 1.1 or more, preferably 2 or more, thereby yielding the preferable compound. Specific examples of (c2·m2a) include (meth)acrylic acid (salt), maleic acid (salt), styrenesulfonic acid (salt), and 2-(meth)acrylamide-2-methylpropanesulfonic acid (salt).

Examples of (c2·m2) excluding (c2·m2a) include (meth) acrylates or (meth)acrylamides having a C1 to C22 hydroxyalkyl group, such as hydroxyethyl (meth)acrylate and hydroxypropyl (meth)acrylamide; (meth)acrylate having a polyalkylene (a linear or branched chain having 1 to 8 carbon atoms in the alkylene group) oxide chain, such as polyethylene glycol (meth)acrylate, methoxy polyethylene glycol (meth)acrylate, lauroxy polyethylene glycol (meth)acrylate (polymerization degree of ethylene glycol: 1 to 100), polypropylene glycol (meth)acrylate (polymerization degree of propylene glycol: 1 to 50), and polybutylene glycol (meth) acrylate (polymerization degree of butylene glycol: 1 to 50); polyhydric alcohol (meth)acrylates such as glycerin (meth) acrylate; acrylamide: diacetone (meth)acrylamide; N-vinyl cyclic amides such as N-vinyl pyrrolidone; N-(meth)acryloyl morpholine; vinyl chloride; and acrylonitrile.

In the present invention, the component (c) obtained by copolymerizing, as (c2·m2), a compound of formula (8) (referred to hereinafter as (c2·m2e)) is preferable from the viewpoint of improving the effect of the silicone compound.

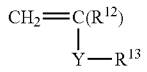

(8)

wherein $R^{12}$ is a hydrogen atom or a methyl group, $R^{13}$ represents a hydrocarbon group having 3 to 22 carbon atoms, and Y represents a linking group (excluding a tertiary amino group or acid salt thereof or an quaternarized product thereof) between $CH_2{=}C(R^{12})$— and $R^{13}$.

In formula (8), $R^{13}$ is preferably an alkyl or alkenyl group having 4 to 20 carbon atoms, more preferably 10 to 18 carbon atoms, and Y is preferably a functional group selected from —COO—, —CONH—, and —OCO—, among which —COO— is particularly preferable.

More specifically, (c2·m2e) is preferably an alkyl (meth) acrylate, the alkyl group moiety of which has 4 to 22 carbon atoms, preferably 4 to 20 carbon atoms, and more preferably 10 to 18 carbon atoms, a (meth) acryloyl aminoalkyl, the alkyl group moiety of which has 4 to 22 carbon atoms, preferably 4 to 20 carbon atoms, and more preferably 10 to 18 carbon atoms, or a vinyl carboxylate, the carboxylic acid moiety of which has 4 to 22 carbon atoms, preferably 4 to 20 carbon atoms, and more preferably 10 to 18 carbon atoms.

The compound as the component (c2) in the present invention is preferably a polymer compound obtained by polymerizing the following monomers in the following amounts: (c2·m1) in an amount of 50 to 100 mol %, preferably 60 to 95 mol %; (c2·m2e), 0 to 50 mol %, preferably 5 to 40 mol %; (c2·m2a), 45 mol % or less, preferably 25 mol % or less; (c2·m2) excluding (c2·m2e) and (c2·m2a), 45 mol % or less, preferably 25 mol % or less. The (c2·m1)/(c2·m2a) ratio (molar ratio) is not lower than 1/0.9, preferably not lower than 1/0.5.

The component (c2) in the present invention is obtained by polymerizing the monomers (c2·m1) and (c2·m2) in any of usual methods that are preferably methods including, but not limited to, a radical polymerization method that can be carried out in a bulk, solution or emulsion system.

The weight-average molecular weight of the component (c2) in the present invention is preferably 3,000 to 100,000, more preferably 4,000 to 80,000, particularly preferably 5,000 to 60,000. The weight-average molecular weight can be determined by gel permeation chromatography with polyethylene glycols as standards in a mixed solution of acetonitrile and water (phosphate buffer) or a mixed solution of ethanol and water (with LiBr/acetic acid) as an eluent.

<Other Components>

Since the components (a1) and (b) in the present invention are compounds substantially insoluble or little soluble in water, a nonionic surfactant (referred to hereinafter as component (d)), although not particularly required when a stable dispersion can be obtained by self-dispersion etc., is preferably used in combination therewith for the purpose of preparing a uniform composition such as an aqueous solution. The nonionic surfactant is preferably a compound of formula (2):

$$R^3\text{-}E\text{-}[(R^4O)_o\text{—}H]_p \quad (2)$$

wherein $R^3$ represents an alkyl or alkenyl group having 7 to 22 carbon atoms, $R^4$ represents an alkylene group having 2 or 3 carbon atoms; o is a number of 2 to 150; and E is —O—, —CON— or —N—, and when E is —O—, p is 1, and when E is —CON— or —N—, p is 2.

Specific examples of the compound of formula (2) include those compounds represented by the following formulae:

$$R^3\text{—}O\text{—}(C_2H_4O)_q\text{—}H \quad (3)$$

wherein $R^3$ has the same meaning as defined above, and q is a number of 2 to 150;

$$R^3\text{—}O\text{—}[(C_2H_4O)_r/(C_3H_2O)_s]\text{—}H \quad (4)$$

wherein $R^3$ has the same meaning as defined above, r and s independently represent a number of 2 to 70, respectively, and ethylene oxide ($C_2H_4O$) and propylene oxide ($C_3H_6O$) may be bonded by either random or block addition.

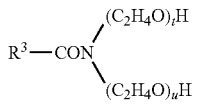

(5)

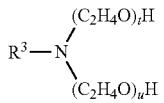

(6)

wherein $R^3$ has the same meaning as defined above, and t and u independently represent a number of 2 to 70, respectively.

In the present invention, those components used ordinarily in fiber treating agents can be arbitrarily used, and such components include, for example, perfumes, dyes, pigments, preservatives, and chelating agents.

<Fiber Product Treating Agent>

The fiber product treating agent of the present invention contains the component (a1) and the component (b) in a component (a1)/component (b) mass ratio of 80/20 to 99.9/0.1; preferably 90/10 to 99/1. In addition to fulfillment of this mass ratio, the fiber product treating agent of the present invention contains the component (a1) in an amount of preferably 1 to 30% by mass, more preferably 1.5 to 20% by mass, even more preferably 2 to 15% by mass, based on the treating agent, and contains the component (b) in an amount of preferably 0.01 to 10% by mass, more preferably 0.03 to 5% by mass, even more preferably 0.05 to 2% by mass, based on the treating agent. The content of the component (c) in the treating agent is preferably 0.2 to 20% by mass, more preferably 0.5 to 15% by mass, even more preferably 1 to 10% by mass. The mass ratio of the component (a1) to the component (c), that is, the component (a1)/component (c) is preferably 5/95 to 99/1, more preferably 10/90 to 90/10. The mass ratio of the component (b) to the component (c), that is, the component (b)/component (c) is preferably 1/999 to 90/10, more preferably 1/99 to 80/20.

The content of the component (d) in the treating agent is preferably 1 to 30% by mass, more preferably 2 to 25% by mass, even more preferably 3 to 20% by mass. The mass ratio of the component (a1) to the component (d), that is, the component (a1)/component (d) is preferably 95/5 to 5/95, more preferably 90/10 to 10/90, even more preferably 85/15 to 15/85.

The fiber product treating agent of the present invention contains the component (a2) and the component (b) at a component (a2)/component (b) mass ratio of 80/20 to 99.9/0.1, preferably 90/10 to 99/1. In addition to fulfillment of this mass ratio, the fiber product treating agent of the present invention contains the component (a2) in an amount of preferably 1 to 30% by mass, more preferably 1.5 to 20% by mass, even more preferably 2 to 15% by mass, based on the treating agent, and contains the component (b) in an amount of preferably 0.01 to 10% by mass, more preferably 0.03 to 5% by mass, even more preferably 0.05 to 2% by mass, based on the treating agent. The content of the component (c) in the treating agent is preferably 1 to 30% by mass, more preferably 2 to 25% by mass, even more preferably 3 to 20% by mass. The mass ratio of the component (a2) to the component (d), that is, the component (a2)/component (d) is preferably 95/5 to 5/95, more preferably 90/10 to 10/90, even more preferably 85/15 to 15/85.

When the component (a2) is used, the content of the component (c) in the treating agent is preferably 0.2 to 20% by mass, more preferably 0.5 to 15% by mass, even more preferably 1 to 10% by mass. The mass ratio of the component (a2) to the component (c), that is, the component (a2)/component (c) is preferably 5/95 to 99/1, more preferably 10/90 to 90/10. The mass ratio of the component (b) to the component (c), that is, the component (b)/component (c) is preferably 1/999 to 90/10, more preferably 1/99 to 80/20.

For the purpose of improving storage stability and the outward appearance of a product, a water-soluble solvent can be appropriately used. The water-soluble solvent is preferably a monohydric alcohol having 1 to 3 carbon atoms, a dihydric alcohol having 2 to 4 carbon atoms, glycerin, or a glycol ether compound of formula (9) below. The content of the water-soluble solvent in the treating agent, although being not particularly limited, is preferably 0.5 to 40% by mass, more preferably 1 to 30% by mass, even more preferably 2 to 20% by mass, because of the problems of its ignition point and smell.

$$R^{14}—O—(R^{15}—O)_s—R^{16} \quad (9)$$

wherein $R^{14}$ is selected from an alkyl group having 1 to 5 carbon atoms, a phenyl group, and a benzyl group, $R^{15}$ is selected from an ethylene group, a propylene group, and $—CH_2—CH(OH)—CH_2—$, $R^{16}$ is selected from a hydrogen atom and an alkyl group having 1 to 5 carbon atoms, and s represents a number of 1 to 5.

The fiber product treating agent of the present invention is preferably in the form of a liquid composition having the components dissolved, dispersed or emulsified in water, particularly preferably in the form of an aqueous solution, wherein the content of water in the treating agent is preferably 20 to 90% by mass, more preferably 30 to 80% by mass, even more preferably 40 to 70% by mass. The pH of the treating agent of the present invention at 20° C. is 2 to 8, preferably 3 to 7, and the pH can be regulated in this range with an ordinarily used acid or base, for example an acid such as hydrochloric acid, sulfuric acid, phosphoric acid, citric acid, lactic acid or acetic acid, and a base such as sodium hydroxide, potassium hydroxide, sodium carbonate, potassium carbonate or an alkanolamine.

Preferably the fiber product treating agent of the present invention is added to rinsing water at a rinsing stage in a washing process to treat fiber products, wherein the treating agent is added in an amount of 1.5 to 75 g, preferably 3 to 60 g, more preferably 4.5 to 45 g, per 30 L of rinsing water. Preferably the treating agent of the present invention is used in an amount of 1 to 50 g, preferably 2 to 40 g, particularly preferably 3 to 30 g, per kg of fiber products. After treatment, usually conducted steps such as dewatering and drying can be carried out. By way of example, the fiber product treating agent of the present invention is used preferably in an amount of 1 to 50 g per kg of fiber products.

EXAMPLES

The following examples are examples of the present invention. These examples are illustrative of the present invention and are not intended to limit the present invention.

The present invention wherein the component (a1) is used is described by reference to invented products 1-1 to 1-5.

The present invention wherein the component (a2) is used is described by reference to invented products 2-1 to 2-7.

The compounding ingredients used in the Examples are collectively shown below.

<Component (a1)>

Component (a1)

(a1)-1: KF-864 (amino-modified dimethyl polysiloxane, manufactured by Shin-Etsu Chemical Co., Ltd.);

(a1)-2: SF8457C (amino-modified dimethyl polysiloxane, manufactured by Dow Corning Toray Silicone Co., Ltd.);

(a1)-3: SH3775M (polyoxyalkylene-modified dimethyl polysiloxane, manufactured by Dow Corning Toray Silicone Co., Ltd.);

(a1)-4: FZ-2203 (polyoxyalkylene-modified dimethyl polysiloxane, manufactured by Dow Corning Toray Silicone Co., Ltd.); and (a1)-5: BY16-906 (amide-modified dimethyl polysiloxane, manufactured by Dow Corning Toray Silicone. Co., Ltd.).

<Component (a2)>

Component (a2)

(a2)-1: KF-393 (amino-modified silicone, manufactured by Shin-Etsu Chemical Co., Ltd.);

(a2)-2: KF-864 (amino-modified silicone, manufactured by Shin-Etsu Chemical Co., Ltd.);

(a2)-3: BY16-203 (amino-modified silicone, manufactured by Dow Corning Toray Silicone Co., Ltd.);

(a2)-4: BY16-891 (amide polyether-modified silicone, manufactured by Dow Corning Toray Silicone Co., Ltd.);

(a2)-5: BY16-893 (amino polyether-modified silicone, manufactured by Dow Corning Toray Silicone Co., Ltd.);

(a2)-6: KF-859 (amino-modified silicone, manufactured by Shin-Etsu Chemical Co., Ltd.); and (a2)-7: BY16-849 (amino-modified silicone, manufactured by Dow Corning Toray Silicone Co., Ltd.).

<Component (b)>

(b)-1: SOREZ 100 (manufactured by International Specialty Products Inc. (ISP); weight-average molecular weight, 7100; the number of moles of EO added on average, 88.9);

(b)-2: Texcare SRN-170 (manufactured by Clariant; weight-average molecular weight, 2700; the number of moles of Wadded on average, 33.7,);

(b)-3: Texcare SRN-240 (manufactured by Clariant; weight-average molecular weight, 6200; the number of moles of EO added on average, 80.5); and (b)-4: Texcare SRN-325 (manufactured by Clariant; weight-average molecular weight, 12000; the number of moles of EO added on average, 35.6).

Each of (b)-1 to (b)-4 is a polymer compound containing a monomer structural unit 1 of formula (1) and a monomer structural unit m of formula (m) below such that the molar ratio of 1/m is in the range of from 10/90 to 90/10. EO is an abbreviation of ethylene oxide (this applies hereinafter).

<Component (c)>

(c1)-1: dialkyl (C12 to C14) dimethylammonium chloride;

(c1)-2: alkyl (C16 to C18) trimethylammonium chloride;

(c2)-1: DMAEMA/LMA (DMAEMA/LMA (molar ratio)=80/20, (PEG-equivalent) weight-average molecular weight 11,000); and (c2)-2: MERQUAT 280 (dimethyldiallyl ammonium/acrylic acid=65/35, manufactured by NALCO Company).

The Above Symbols are as Follows:

DMAEMA: N-(meth)acryloyloxyethyl-N,N-dimethylamine, and

LAM: lauryl methacrylate.

<Component (d)>

(d)-1: a nonionic surfactant having 40 moles on average of EO added to a linear primary alcohol having 12 to 14 carbon atoms;

(d)-2: a nonionic surfactant having 20 moles on average of EO added to stearyl alcohol;

(d)-3: a nonionic surfactant having 50 moles on average of EO added to stearyl alcohol;

(d)-4: a nonionic surfactant having 140 moles on average of EO added to stearyl alcohol;

(d)-5: a nonionic surfactant having 5 moles on average of EO/2 moles on average of PO/3 moles on average of EO added in this order to a linear primary alcohol having 12 to 14 carbon atoms; and (d)-6: a nonionic surfactant having 3 moles on average of EO added to a secondary alcohol having 12 to 14 carbon atoms.

PO is an abbreviation of propylene oxide.

PhG-30: a glycol ether compound having 3 moles on average of EO added to phenol.

Antibacterial agent: Proxel IB

Chelating agent: ethylenediaminetetraacetic acid (Evaluation of Water-Absorbing Property)

1.5 kg of 1 m×1 m calico 2003 cloth (100% cotton) was washed with a commercially available clothing detergent (Attack, manufactured by Kao Corporation) in a twin-tub type washing machine (Toshiba Ginga VH-360S1) (detergent concentration: 0.0667% by mass, using 30 L (20° C.) of tap water, washing (10 minutes)-dewatering (3 minutes)-rinsing (8 minutes) (rinsing in water stream, amount of water: 15 L/min.)). The flow of water was stopped 5 minutes after rinsing was started, the washed water was drained off and then the calico cloth was dewatered for 3 minutes. Then, 30 L of tap water (20° C.) was poured into the washing machine, and 15 mL of each treating agent in Table 1-1 and Table 2-1 was poured, followed by stirring treatment for 3 minutes. After stirring was stopped, the calico 2003 cloth was dewatered for 3 minutes, then taken out and air-dried at room temperature. A series of these washing procedures were conducted repeatedly 20 times to treat the calico cloth which was then air-dried at room temperature for 4 hours and left for 24 hours in a standard test room (25° C./65% RH), thereby humidity-conditioning it.

The humidity-conditioned calico 2003 cloth was cut into pieces of 2.5 cm×25 cm in length, and the cut cloth with the short side down was dipped to a depth of 1 cm in deionized water at 20° C. After 10 minutes of dipping, the height, from the water surface, of water absorbed into the cloth by capillary phenomenon was measured (JIS L1907 (a method of examining the water-absorbing property of a fiber product)). In Tables 1-1 and 2-1, a product showing a water-absorption height of 8 cm or more is denoted by ◎; 6 cm or more to less than 8 cm, ○; 4 cm or more to less than 6 cm, Δ; and less than 4 cm, x. The water-absorption height of the calico 2003 cloth not subjected to the softening treatment was 10 cm.

(Evaluation of Softness)

Commercial available 5 cotton towels (white, 100% cotton) plus clothes for regulation of mass, that is, 0.8 kg underwear (100% cotton) and 0.4 kg shirt (white, cotton/polyester=60/40(%)) were washed repeatedly 10 times with a commercially available clothing detergent (Attack, manufactured by Kao Corporation) in a twin-tub type washing machine (Toshiba Ging a VH-360S1) (detergent concentration: 0.0667% by mass, using 30 L (20° C.) of tap water, washing (10 minutes)-dewatering (3 minutes)-rinsing (8 minutes) (rinsing in water stream, amount of water: 15 L/min.)). The flow of water was stopped 5 minutes after rinsing in the final (10th) treatment was started, the washed water was drained off and then the towels were dewatered for 3 minutes. Then, 30 L of tap water (20° C.) was poured into the washing machine, and 15 mL of each treating agent in Table 1-1 was poured, followed by stirring treatment for 3 minutes. After stirring was stopped, the towels were dewatered for 3 minutes, then taken out as fiber products to be evaluated, and air-dried for 4 hours at room temperature.

The towels thereafter humidity-conditioned by leaving them for 24 hours in a standard test room (25° C./65% RH), and control towels separately treated with comparative product 1-1 in Table 1-1 and then humidity-conditioned in the same manner in the standard test room (25° C./65% RH), were scored for their softness by 10 judges (5 men in their thirties and 5 women in their thirties) under the following criteria, to determine the average point. In Table 1-1, a product with the average point higher than 0.5 to 1.0 or less is denoted by ○; 0 or more to 0.5 or less, Δ; and less than 0, x.

Softer than the control: +1 point

The same as the control: 0 point

The control is softer: −1 point

TABLE 1-1

| | | | Product of the invention | | | | | Comparative product | | | |
|---|---|---|---|---|---|---|---|---|---|---|---|
| | | | 1-1 | 1-2 | 1-3 | 1-4 | 1-5 | 1-1 | 1-2 | 1-3 | 1-4 |
| Compounding component (mass %) | (a) | (a1)-1 | 5.0 | | 4.0 | 3.0 | | 5.0 | 4.0 | 3.0 | 5.0 |
| | | (a1)-2 | | 5.0 | | | 3.0 | | | | |
| | | (a1)-3 | | | 1.0 | | | | 1.0 | | |
| | | (a1)-4 | | | | 2.0 | | | | 2.0 | |
| | | (a1)-5 | | | | | 2.0 | | | | |
| | (b) | (b)-1 | 0.2 | 0.1 | | | | | | | 0.2 |
| | | (b)-2 | | | 0.2 | | | | | | |
| | | (b)-3 | | 0.1 | | 0.5 | 0.5 | | | | |
| | | (b)-4 | | | | | 0.5 | | | | |

TABLE 1-1-continued

| | | Product of the invention | | | | | Comparative product | | | |
|---|---|---|---|---|---|---|---|---|---|---|
| | | 1-1 | 1-2 | 1-3 | 1-4 | 1-5 | 1-1 | 1-2 | 1-3 | 1-4 |
| (c) | (c1)-1 | 6.0 | 5.0 | 6.0 | 4.0 | 5.0 | 6.0 | 6.0 | 4.0 | |
| | (c1)-2 | | 1.0 | | | | | | | |
| | (c2)-1 | | | | 1.0 | | | | 1.0 | |
| | (c2)-2 | | | | | 1.0 | | | | |
| (d) | (d)-1 | 5.0 | 4.0 | 4.0 | | | 5.0 | 4.0 | | 5.0 |
| | (d)-2 | | 1.0 | | 3.0 | | | | 3.0 | |
| | (d)-3 | | | 1.0 | 2.0 | 3.0 | | 1.0 | 2.0 | |
| | (d)-4 | | | | | 2.0 | | | | |
| | (d)-5 | 2.0 | 1.0 | | 2.0 | 1.0 | 2.0 | | 2.0 | 2.0 |
| | (d)-6 | 2.0 | 3.0 | 3.0 | 2.0 | 3.0 | 2.0 | 3.0 | 2.0 | 2.0 |
| | Ethanol | 1.0 | 1.0 | 1.0 | 1.0 | 1.0 | 1.0 | 1.0 | 1.0 | 1.0 |
| | Glycerine | 2.0 | 1.0 | | 2.0 | 2.0 | 2.0 | | 2.0 | 2.0 |
| | PhG-30 | 4.0 | 5.0 | 6.0 | 4.0 | 4.0 | 4.0 | 6.0 | 6.0 | 4.0 |
| | Hydrochloric acid | Amount for adjusting to pH 4.0 (20° C.) | | | | | Amount for adjusting to pH 4.0 (20° C.) | | | |
| | Antibacterial agent | 0.1 | 0.1 | 0.1 | 0.1 | 0.1 | 0.1 | 0.1 | 0.1 | 0.1 |
| | Chelating agent | 0.01 | 0.01 | 0.01 | 0.01 | 0.01 | 0.01 | 0.01 | 0.01 | 0.01 |
| | Perfume | 0.5 | 0.5 | 0.5 | 0.5 | 0.5 | 0.5 | 0.5 | 0.5 | 0.5 |
| | Water | Balance | Balance | Balance | Balance | Balance | Balance | Balance | Balance | Balance |
| | Total | 100 | 100 | 100 | 100 | 100 | 100 | 100 | 100 | 100 |
| Water-absorbing property | | ◎ | ◎ | ○ | ◎ | ◎ | X | X | Δ | ◎ |
| Softness | | ○ | ○ | ○ | ○ | ○ | ○ | ○ | ○ | X |

TABLE 2-1

| | | | Product of the invention | | | | | | | Comparative product | | |
|---|---|---|---|---|---|---|---|---|---|---|---|---|
| | | | 2-1 | 2-2 | 2-3 | 2-4 | 2-5 | 2-6 | 2-7 | 2-1 | 2-2 | 2-3 |
| Compounding component (mass %) | (a) | (a2)-1 | 3.0 | | | | | 1.0 | | | 1.0 | |
| | | (a2)-2 | | 5.0 | | | | | | | | |
| | | (a2)-3 | | | 7.0 | | | | 3.0 | 7.0 | | 3.0 |
| | | (a2)-4 | | | | | | 3.0 | | | 3.0 | |
| | | (a2)-5 | | | | | | | 3.0 | | | 3.0 |
| | | (a2)-6 | | | | 5.0 | | | | | | |
| | | (a2)-7 | | | | | 4.0 | | | | | |
| | (b) | (b)-1 | 0.5 | 0.3 | | | | | | | | |
| | | (b)-2 | | | 0.2 | | | | | | | |
| | | (b)-3 | | | | 1.0 | | 0.2 | 0.1 | | | |
| | | (b)-4 | | | | | 0.1 | | 0.1 | | | |
| | (c) | (c1)-1 | 3.0 | 5.0 | | | | | | | | |
| | | (c1)-2 | | | | | | | | | | |
| | | (c2)-1 | | | | | | 2.0 | | | 2.0 | |
| | | (c2)-2 | | | | | | | 1.0 | | | 1.0 |
| | (d) | (d)-1 | 5.0 | 4.0 | 4.0 | | 5.0 | | | 4.0 | | |
| | | (d)-2 | | 1.0 | | | | 3.0 | | | 3.0 | |
| | | (d)-3 | | | 1.0 | 5.0 | | 2.0 | 3.0 | 1.0 | 2.0 | 3.0 |
| | | (d)-4 | | | | | | | 2.0 | | | 2.0 |
| | | (d)-5 | 2.0 | 1.0 | | | | 2.0 | 1.0 | | 2.0 | 1.0 |
| | | (d)-6 | 2.0 | 3.0 | 3.0 | | | 2.0 | 3.0 | 3.0 | 2.0 | 3.0 |
| | | Ethanol | 1.0 | 1.0 | 1.0 | | | 1.0 | 1.0 | 1.0 | 1.0 | 1.0 |
| | | Glycerine | 2.0 | 1.0 | | | 1.0 | 2.0 | 2.0 | 2.0 | | 2.0 |
| | | PhG-30 | 4.0 | 5.0 | 6.0 | 7.0 | 8.0 | 4.0 | 4.0 | 4.0 | 6.0 | 6.0 |
| | | Hydrochloric acid | Amount for adjusting to pH 4.0 (20° C.) | | | | | | | Amount for adjusting to pH 4.0 (20° C.) | | |
| | | Antibacterial agent | 0.1 | 0.1 | 0.1 | 0.1 | 0.1 | 0.1 | 0.1 | 0.1 | 0.1 | 0.1 |
| | | Chelating agent | 0.01 | 0.01 | 0.01 | 0.01 | 0.01 | 0.01 | 0.01 | 0.01 | 0.01 | 0.01 |
| | | Perfume | 0.5 | 0.5 | 0.5 | 0.5 | 0.5 | 0.5 | 0.5 | 0.5 | 0.5 | 0.5 |
| | | Water | Balnace | Balnace | Balnace | Balnace | Balnace | Balnace | Balnace | Balnace | Balnace | Balnace |
| | | Total | 100 | 100 | 100 | 100 | 100 | 100 | 100 | 100 | 100 | 100 |
| Water-absorbing property | | | 8 cm or more | 8 cm or more | 6 cm or more to less than 8 cm | 6 cm or more to less than 8 cm | 6 cm or more to less than 8 cm | 8 cm or more | 6 cm or more to less than 8 cm | Less than 6 cm | Less than 6 cm | Less than 6 cm |

Any of the invented products and the comparative products in Table 2-1 conferred softness at high level.

The invention claimed is:

1. A fiber product treating agent comprising (a1) a silicone compound, (b) a polymer compound having a weight-average molecular weight of 1,000 to 100,000, comprising an alkylene terephthalate unit and/or an alkylene isophthalate unit, and a polyoxyalkylene unit, and (c) at least one compound selected from the group consisting of (c1) a tertiary amine compound, or acid salt thereof, or a quaternization product thereof, wherein 1 to 3 groups of 3 or 4 groups bound to the nitrogen atom thereof each represent a hydrocarbon group having 10 to 24 carbon atoms and the remaining group(s) represents an alkyl or hydroxyalkyl group having 1 to 3 carbon atoms and (c2) a cationic water-soluble polymer compound, wherein the mass ratio of (a1) to (b) is (a1)/(b)=80/20 to 99.9/0.1;

wherein the polymer compound (b) comprises a monomer structural unit (1-1) of formula (1-1) and a monomer structural unit (1-2) of formula (1-2) wherein the molar ratio of (1-1)/(1-2) is from 10/90 to 90/10:

(1-1)

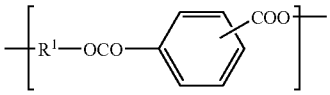

(1-2)

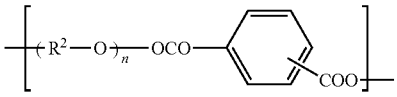

wherein $R^1$ and $R^2$ each represent an alkylene group having 2 or 3 carbon atoms, and may be the same as or different from each other, and n is a number of 1 to 150 on the number average.

2. The fiber product treating agent according to claim 1, wherein (a1) is at least one selected from the group consisting of dimethyl polysiloxane, a amino-modified dimethyl polysiloxane, and a polyoxyalkylene-modified dimethyl polysiloxane.

3. The fiber product treating agent according to claim 1, which further comprises (d) a nonionic surfactant.

4. A method of treating a fiber product, which comprises adding the fiber product treating agent of claim 1 to rinsing water in a rinsing step of washing to treat the fiber product.

5. A fiber product treating agent comprising (a2) an amino-modified silicone compound and/or an amide-modified silicone compound and (b) a polymer compound having a weight-average molecular weight of 1,000 to 100,000, comprising an alkylene terephthalate unit and/or an alkylene isophthalate unit, and a polyoxyalkylene unit, wherein the mass ratio of (a2) to (b) is (a2)/(b)=80/20 to 99.9/0.1;

wherein the polymer compound (b) comprises a monomer structural unit (1-1) of formula (1-1) and a monomer structural unit (1-2) of formula (1-2) wherein the molar ratio of (1-1)/(1-2) is from 10/90 to 90/10:

(1-1)

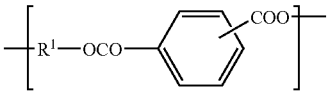

(1-2)

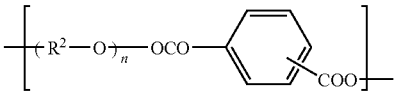

wherein $R^1$ and $R^2$ each represent an alkylene group having 2 or 3 carbon atoms, and may be the same as or different from each other, and n is a number of 1 to 150 on the number average.

6. The fiber product treating agent according to claim 5, which further comprises (d) a nonionic surfactant.

* * * * *